US012263989B2

(12) United States Patent
Mentasti Granelli

(10) Patent No.: US 12,263,989 B2
(45) Date of Patent: Apr. 1, 2025

(54) LID FOR CONTAINERS OF SUBSTANCES, AND CONTAINER OF SUBSTANCES COMPRISING SAID LID

(71) Applicant: OC BEV LTD, London (GB)

(72) Inventor: Kerry Mentasti Granelli, London (GB)

(73) Assignee: OC BEV LTD, London (GB)

( * ) Notice: Subject to any disclaimer, the term of this patent is extended or adjusted under 35 U.S.C. 154(b) by 38 days.

(21) Appl. No.: 18/005,599

(22) PCT Filed: Jul. 13, 2020

(86) PCT No.: PCT/EP2020/069794
§ 371 (c)(1),
(2) Date: Jan. 13, 2023

(87) PCT Pub. No.: WO2022/012738
PCT Pub. Date: Jan. 20, 2022

(65) Prior Publication Data

US 2023/0264855 A1 Aug. 24, 2023

(51) Int. Cl.
*B65D 17/28* (2006.01)

(52) U.S. Cl.
CPC ..... *B65D 17/4012* (2018.01); *B65D 17/4011* (2018.01); *B65D 17/404* (2018.01); *B65D 2517/0016* (2013.01)

(58) Field of Classification Search
CPC ..... B65D 17/4012; B65D 17/4011; B65D 17/404; B65D 2517/0016
(Continued)

(56) References Cited

U.S. PATENT DOCUMENTS 3,773,210 A 11/1973 Radtke
3,782,586 A * 1/1974 Brown ..... B65D 17/4011 220/270
(Continued)

FOREIGN PATENT DOCUMENTS

WO WO-02/051710 A1 7/2002
WO WO-2009/030526 A1 3/2009
(Continued)

OTHER PUBLICATIONS

International Search Report and Written Opinion for PCT/EP2020/069794, mailed Jun. 30, 2021.

*Primary Examiner* — James N Smalley
(74) *Attorney, Agent, or Firm* — MARSHALL, GERSTEIN & BORUN LLP

(57) ABSTRACT

A lid for a metal container able to contain a substance, includes a closing cap defined by at least one incision or pre-cut line, able to allow the closing cap to be lifted and at least partly torn; an opening lever disposed astride the incision line and comprising a front fulcrum end and an intermediate region provided with a flexible tongue attached to the closing cap; a mechanical connection located in proximity to the incision line, configured to mechanically attach the flexible tongue to the closing cap and configured to cooperate with said flexible tongue; the incision line having at the front, in the zone where the closing cap starts to be lifted and torn, a portion protruding outward, toward the front fulcrum end of the opening lever; and the protruding portion having, on both sides, segments of the incision line which move away from said mechanical connection element as far as respective deformation zones, caused by compression of the incision line.

19 Claims, 4 Drawing Sheets

(58) Field of Classification Search
USPC ..... 220/269, 271
See application file for complete search history.

(56) References Cited

U.S. PATENT DOCUMENTS

| | | | | | |
|---|---|---|---|---|---|
| 4,397,403 | A * | 8/1983 | Guimarin | B65D 17/4012 | 220/269 |
| 4,417,668 | A * | 11/1983 | Stolle | B65D 17/4012 | 220/269 |
| 4,503,989 | A | 3/1985 | Brown et al. | | |
| 5,129,541 | A * | 7/1992 | Voigt | B65D 17/4012 | 220/269 |
| 5,738,237 | A | 4/1998 | McEldowney | | |
| 5,964,366 | A | 10/1999 | Hurst et al. | | |
| 6,715,629 | B2 * | 4/2004 | Hartman | B21D 51/383 | 220/269 |
| 6,908,005 | B1 | 6/2005 | Strube et al. | | |
| 8,783,495 | B2 | 7/2014 | Forrest | | |
| 9,555,922 | B2 * | 1/2017 | Consonni | B65D 17/4012 | |
| 2003/0111469 | A1 | 6/2003 | Hartman et al. | | |
| 2014/0263332 | A1 | 9/2014 | Frank | | |

FOREIGN PATENT DOCUMENTS

| | | | |
|---|---|---|---|
| WO | WO-2011/001273 | A1 | 1/2011 |
| WO | WO-2015/104659 | A1 | 7/2015 |

* cited by examiner

LID FOR CONTAINERS OF SUBSTANCES, AND CONTAINER OF SUBSTANCES COMPRISING SAID LID

FIELD OF THE INVENTION

The present invention concerns lids, and containers, or cans, equipped with said lids, which are normally used to contain substances, in particular, but not exclusively, substances that can be taken by humans or animals, for example beverages, drinks, food substances in general, food supplements, pharmaceutical substances and cosmetic products. Such substances can be in fluid or liquid form, as well as in solid form, for example granular, powder or other.

For example, in the case of drinks, these can in particular be fizzy or carbonated drinks or beverages, generally with carbon dioxide added and, therefore, the containers discussed here can be containers able to resist pressure, for example, internal pressure of about 5.4 atmospheres (80 psi) or more, for instance up to about 6 to 8 atmospheres (90 to 120 psi) or even more.

The lid according to the present invention is also suitable for making watertight containers for special products, such as seeds, laboratory products, chemical products, or others.

In particular, the description refers to lids, and corresponding containers, or cans, including the lids, advantageously, but not exclusively, made of aluminum, or aluminum alloys, as well as other metal materials, such as iron-based materials, for instance steel or steel-based alloys, tin-based metal materials, or other suitable metals or alloys, or combination thereof, in which a closing cap is provided which hermetically closes a delivery aperture. The closing cap is initially an integral part of the lid and subsequently, when a part is at least partly torn, determines the formation of a delivery aperture, remaining integral with the cap ("stay-on tab"). According to a variant, the closing cap is completely separated from it when opened for delivery ("ring pull").

In particular, the present invention concerns lids, and containers equipped with said lids, in which said part, possibly configured as a closing cap with or without an opening lever, at no time in the tearing and opening, enters inside the container, that is, it concerns lids and containers of the hygienic type, or, in particular, of the non-contaminating type.

The containers according to the present invention, depending on what they have to contain, may have the internal surface made of the metal that constitutes the container, or the internal surface may have a protective film of material consistent and compatible with the content, or of materials which are consistent and compatible with the content and which prevent contact between content and external container.

BACKGROUND OF THE INVENTION

Documents WO-A-2009/030526 and WO-A-2011/001273 in the name of the Applicant are known, concerning lids and containers provided with such lids to contain a substance, in which there is a closing cap with pull-off opening, which remains integral with the lid once opened (stay-on tab). In these known documents, a rivet is provided that connects an opening lever to the closing cap, which rivet is disposed inside an incision line that defines the closing cap.

Document U.S. Pat. No. 4,503,989 is also known, which describes a lid with a closing cap with pull-off opening, defined by an incision line with an open profile, to obtain a configuration of the "stay-on tab" type, wherein there is an opening lever connected to the closing cap by means of an integral rivet, which is disposed inside the perimeter defined by the incision line.

Furthermore, document U.S. Pat. No. 3,773,210 is also known, which describes a lid with a closing cap with pull-off opening, defined by an incision line with a closed profile, to obtain a completely removable cap. In this case too, a rivet is provided to connect the opening lever to the closing cap, disposed inside the closed profile incision line.

If the substances contained in the containers in question are to be taken by humans or animals, there is a great need to ensure that the closing cap does not enter, even to a small extent, inside the container. This requirement derives from the fact that the external part of the closing cap can contain various contaminants and if it entered the container it could therefore contaminate the contents. Therefore, the problem arises of preventing contamination of the substance inside the container and the necessity arises to make hygienic lids and containers. This is to prevent foreign substances such as dust, dirt, germs, bacteria or other pathogens from being introduced into the product in the container.

This necessity is most urgent in places where the containers are kept, even only temporarily, in the open or in unprotected environments, where the strangest substances can be deposited on the lid. In this case, if, as an indicative example, the container contains a drink or medicine, if the closing cap carries the substances into the container, dangerous conditions can also materialize for the user.

This necessity is also felt in particular in the case of taking pharmaceutical substances, in which the pathological condition of the person or animal taking these substances may not support the presence of said contaminants, pollutants or pathogens. This may also apply to substances used for sport activities or the like, such as for instance sport foods or dietary supplements.

Systems known in the state of the art can suffer from the disadvantage that even a minimal part of the closing cap goes, or faces, although temporarily, toward the inside of the container, at the time of the pull-off opening, thereby creating hygiene and health problems.

Additionally, with known systems there is a limit to the use of complete containers with such lids, as there is no guarantee of hygiene and/or non-contamination. This limit prevents the use of such containers for the transport and/or storage of contaminating material, or of material that must not be contaminated.

Furthermore, with known systems there are limits in the type of content, and therefore such known systems are unsuitable, in certain cases, for the passage of a sufficient quantity of air in the short time when the cap is actuated, which creates turbulence for the liquid at exit.

Another known container lid is described in document WO-A-2015/104659, in the name of the Applicant.

The lid for containers comprises: a closing cap defined by an incision line and provided with a front portion; an opening lever disposed astride the incision line and comprising a front fulcrum end disposed at the front of the front portion and an intermediate region provided with a flexible tongue attached to the closing cap; a mechanical element configured to mechanically attach the flexible tongue to the closing cap and provided with an upper abutment head; the head is configured to cooperate with the flexible tongue and is delimited perimetrically by an external periphery. The mechanical element is disposed essentially tangent to the front portion of the incision line, and the external periphery of the upper abutment head is aligned orthogonally to the incision line.

Although the lid for containers described in document WO-A-2015/104659 has undoubted advantages and can be considered an evolution with respect to other known lids for containers, the lid can also be improved with regard to the effectiveness of the closing system, for example, with regard to the hygiene and non-contamination of the substance present in the container.

Furthermore, the lid described in this document can be improved with regard to its effectiveness in preventing phenomena of venting/bursting, in particular unintended or explosive venting, which, for example, could occur in the case of containers characterized by a certain internal pressure, for example containers containing a carbonated, sparkling or similar drink, that is, one to which carbon dioxide is generally added. In particular, the phenomenon of "venting", that is, the escape of the gases present in the container, normally occurs when the opening lever is lifted, creating a tension on the incision line, until the latter is broken. At this point, the pressure in the container can be released through the zone that has been fractured; however, until the pressure in the container is released, a certain force is still applied on the opening lever. Once the incision line is broken, it is much easier to open the closing cap, because at this point a shear stress is applied to break the incision line, and not a lifting tension. Therefore, in such containers containing a pressurized gas which has to vent, in the first opening steps, when the gas is released from the container (venting), the gas pressure is added to the traction force exerted by the user on the opening lever. This traction added to the pressure exerted by the gas could lead to an unwanted and premature tearing of the closing cap from the container.

There is therefore a need to perfect a lid for containers which can overcome at least one of the disadvantages of the state of the art.

In particular, one purpose of the present invention is to provide a lid for containers which is equipped with an improved closing system which, when opened, substantially guarantees the hygiene and non-contamination of the substance present in the container, preventing even the smallest part of the closing cap from going inside the container during opening.

Another purpose of the present invention is to provide a lid for containers which allows to greatly limit the phenomena of venting/bursting, in particular unintended or explosive venting, thanks to an effective conformation of the incision line, in particular in the zone where the closing cap of the lid begins to detach, by means of the corresponding opening lever.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the invention or variants to the main inventive idea.

In accordance with the above purposes, a lid according to the present invention for a metal container able to contain a substance comprises:

- a closing cap defined by at least one incision or pre-cut line, able to allow the closing cap to be lifted and at least partly torn,
- an opening lever disposed astride the incision line and comprising a front fulcrum end and an intermediate region provided with a flexible tongue attached to the closing cap,
- an incision line having at the front, in the zone where the closing cap starts to be lifted and torn, a portion protruding outward, toward the front fulcrum end of the opening lever,
- a mechanical element located in proximity to the incision line, configured to mechanically attach the flexible tongue to the closing cap and configured to cooperate with the flexible tongue.

According to one aspect of the invention, the protruding portion has, on both sides, segments of the incision line which move away from the mechanical element as far as respective deformation zones, caused by compression of the incision line.

Advantageously, thanks to the particular conformation of the incision line in correspondence with the protruding portion and to the presence of the deformation zones caused by compression which substantially delimit the protruding portion, the lid according to the invention allows to greatly limit the phenomena of venting/bursting, in particular unintended or explosive venting, in particular in the zone where the closing cap of the lid begins to detach, by means of the corresponding flexible opening tongue.

The present invention therefore solves the problem of allowing an adequate release of gases when opening (venting) in pressurized containers for fizzy or sparkling drinks or beverages, e.g. carbonated drinks or beverages, that is, drinks or beverages to which carbon dioxide is generally added, advantageously for internal pressure of about 5, 4 atmospheres (80 psi) or more, for instance up to about 6 to 8 atmospheres (90 to 120 psi) or even more. This is because a specific zone is defined, by means of the incision line, which defines where the gas is released. This is very important because the closing cap of the lid described here has an increased area compared to traditional "stay-on tabs" of known conventional lids. The incision line therefore has this protruding portion which, in practice, is widened in correspondence with the mechanical element. The geometry of the segments of the incision line, which move away from the mechanical element as far as respective deformation zones caused by compression made in the metal material that defines the lid, gives an advantageous behavior on the occasion of the first opening when the gas escapes (venting), on one hand preventing the closing cap from being torn and, on the other hand, preventing the "venting" action from continuing to open the closing cap in an unintentional and sometimes even violent way. In this respect, in combination with the geometry of the segments of the incision line, the deformation of the material of the incision line in this zone also plays an important role: the mechanical deformation action obtained by mechanical compression of the thickness of the metal material of the lid in this zone in practice moves material of the thickness into correspondence with the path of the incision line. The effect of this displacement of material caused by compression is that the flow of metal material in the path of the incision line changes, and therefore defines in a desired way a localized resistance to the shearing stress during opening, so that it is possible to control the venting action in a very specific point or zone, but without requiring an excessive increase in the force to be applied which is necessary to pull the opening lever. In other words, thanks to the combination of the geometry of the wide protruding portion, of the segments of the incision line and of the deformation zone caused by compression of the material of the incision line, a desired localized "slowdown" of the opening of the closing cap is obtained during the "venting" operation, ensuring that the gases escape properly, but without tearing or lacerating the closing cap.

In some embodiments, the protruding portion in particular can be substantially rounded in shape and have a width of about 8 mm to about 10 mm.

The protruding portion can advantageously, although not essentially, be in the shape of an arc of a circle and have a radius of curvature of about 5 mm to about 6 mm.

Advantageously, the radius of the protruding portion is greater than the radius of the mechanical element and the profile of the protruding portion continues, as we said, moving away from the mechanical element by means of the segments of the incision line as far as the respective deformation zones of the material, where there is a change in the opening direction, defined by an internal radius, able to prevent on the one hand the closing cap from being torn and, on the other hand, to prevent the venting action from continuing to unintentionally open the closing cap, even violently. This aspect, in combination with the deformation zones of the material in this transition region and the change in the opening direction of the incision line, allows to adequately control the venting action.

In particular, each deformation zone caused by compression can comprise at least a first curvature having a concavity facing toward the outside of the lid and at least a second curvature having a concavity facing toward the inside of the lid. The succession of first and second curvatures can advantageously define the transition and modification in the opening direction of the incision line.

The radius of curvature of the first curvature is about 1.5 mm to about 2.5 mm.

The radius of curvature of the second curvature is about 2 mm to about 3 mm.

Each deformation zone can have a diameter of about 1 mm to about 3 mm.

The lid, according to an evolved variant, can also comprise an anti-breaking line positioned around the incision line.

The anti-breaking line is shaped so as to follow the profile of the incision line at least in a zone of the closing cap comprised between a rear flap of the closing cap and the zone of the closing cap where the mechanical element is positioned.

Furthermore, each deformation zone can extend beyond the anti-breaking line.

The anti-breaking line and the incision line can be connected in proximity to the rear flap of the closing cap by a connecting arc.

The radius of curvature of the connecting arc can be about 1.5 mm to about 2.5 mm.

The average distance between the incision line and the anti-breaking line can be about 1 mm to about 2 mm.

The depth of the incision line is preferably greater than the depth of the anti-breaking line.

The lid, in a zone comprised between the incision line and the anti-breaking line, can have a thickness of about 1.5 mm to about 2.5 mm.

Moreover, under the incision line, the lid can have a thickness of about 1 mm to about 1.5 mm.

Furthermore, in correspondence with each deformation zone, the lid can have a thickness of about 1.5 mm to about 2 mm.

The lid can comprise a reinforcement edge defined by at least a first reinforcement line and by at least a second reinforcement line.

The first reinforcement line can be a closed line which completely surrounds the incision line.

The second reinforcement line can be an open line which partly surrounds the first reinforcement line and comprises, on one side and the other of the incision line, two branches which break substantially at the height of the deformation zone caused by compression of the incision line.

The branches of the second reinforcement line can be divergent with respect to the first incision line.

Moreover, in correspondence with the reinforcement edge, the lid can have a thickness of about 0.4 mm to about 0.6 mm.

The minimum distance between the first reinforcement line and the center of the mechanical element is about 5 mm to about 7 mm.

The minimum distance between the anti-breaking line and the center of the mechanical element is about 4 mm to about 5 mm.

The minimum distance between the incision line and the center of the mechanical element can be about 1.5 mm to about 2.5 mm.

The mechanical element can be a rivet having an average diameter of about 3 mm to about 4 mm.

Furthermore, the lid can comprise lateral centering ridges, which cooperate with the front lateral edge of the opening lever in order to center it; each of the lateral centering ridges can have a length of about 7 mm to about 8 mm, a width of about 2 mm to about 3 mm and a height of about 0.2 mm to about 1 mm.

The invention also concerns a container comprising a lid as defined above.

ILLUSTRATION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DESCRIPTION OF EMBODIMENTS

We will now refer in detail to the possible embodiments of the present invention, of which one or more examples are shown in the attached drawings by way of non-restrictive example. The phraseology and terminology used here is for the purpose of non-restrictive example.

Figure 1:
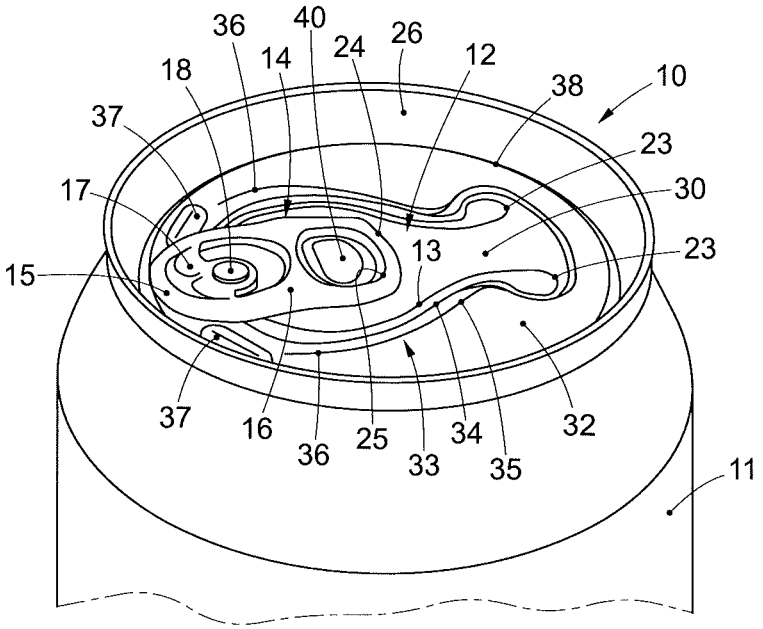
FIG. 1 is a three-dimensional view of a lid for containers according to the present invention.
Figure 2:
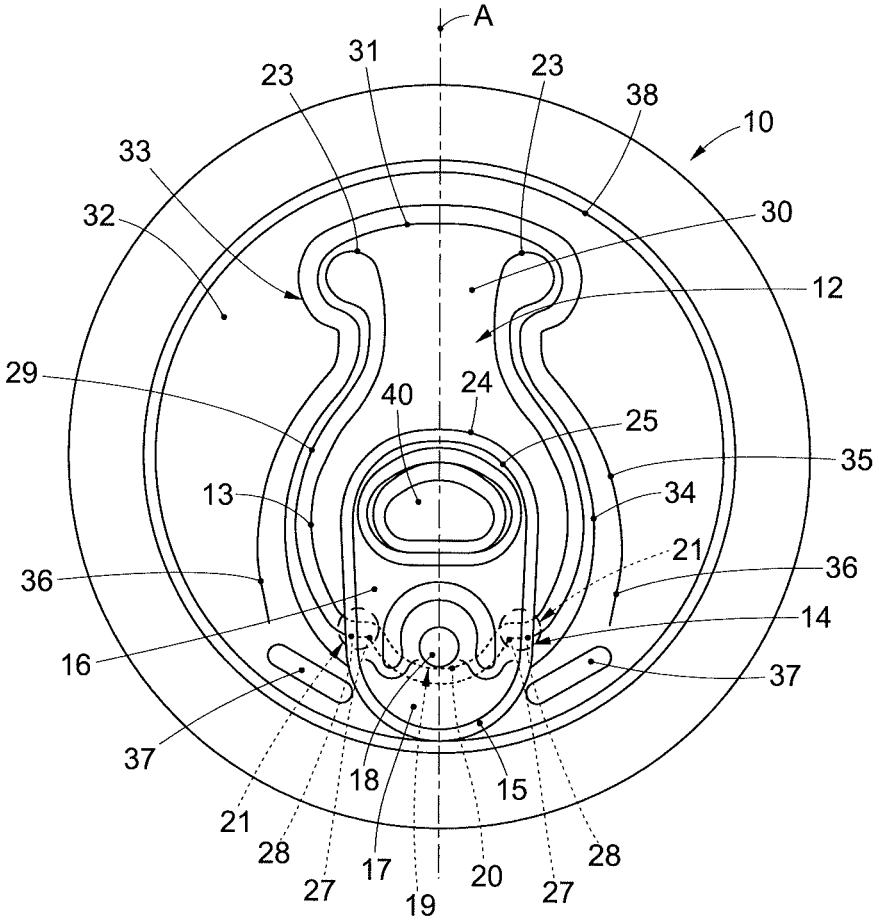
FIG. 2 is a plan view of the lid in FIG. 1.
Figure 3:
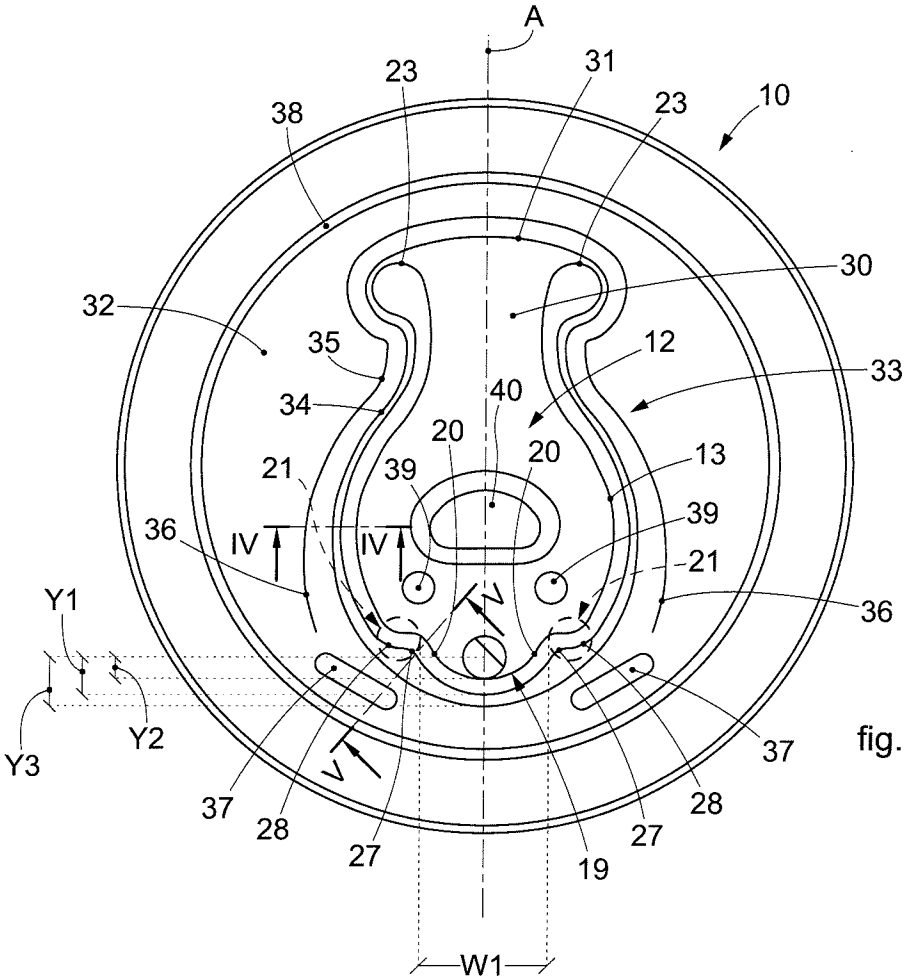
FIG. 3 is another plan view of the lid in FIG. 1 and FIG. 2 without the opening lever.

In the attached drawings, see in particular FIGS. 1, 2 and 3 a lid 10 according to the present invention is shown, usable as a lid for a container 11 able to contain a substance, for example fluid, liquid, powder, granular or other solid form, in particular a pourable substance, for example substances that can be taken by humans or animals, such as drinks, food substances in general, food supplements, pharmaceutical substances, etc.

For example, the liquid substance can be a drink, such as a carbonated drink, a carbonated soft drink, an alcoholic beverage, fruit juice, tea, infusions, beer, an energizing drink or other.

The container 11 can for example be configured as a can for containing drinks or beverages, i.e. canned drinks or beverages. In particular, the container 11 might be a can suitable for containing beverages or drinks held under pressure, especially carbonated beverages or drinks. For instance, the container 11 can resist to internal pressure of about 5, 4 atmospheres (80 psi) or more, for instance up to about 6 to 8 atmospheres (90 to 120 psi) or even more.

Generally, both the lid 10 and the container 11 can be made of metal, such as for example aluminum or its alloys, or an iron-based metal, in particular steel-based, for instance steel or steel-based alloys, as well as tin-based metal materials, or other suitable metals or alloys, or combination thereof. The materials of the lid 10 and container 11 could be different from each other. The materials are also consistent and compatible with the substance contained. For example, for carbonated drinks, that is to say, those with added gas or which contain gas caused by fermentation, the lid 10 can be, as normally happens, made of aluminum or iron, or their alloys, or other suitable metal materials.

It can also be provided that the internal part of the container 11, and of the lid 10, is covered with a special coating, for example a protective film consistent and compatible with the needs of the content. Protection with materials such as plastic, ceramic or other similar materials may also be provided, depending on the content and/or time it is contained. Advantageously, but not necessarily, the coating is solidly attached to the internal surface of the container 11.

The sizes of the container 11 can be similar, in plan, to those of the lid 10, or they can be bigger, just as they can be smaller. Thus, for example the container 11 can have the same diameter as the lid 10, or it can have a larger diameter, or a smaller diameter.

Preferably, the lid 10 according to the present invention is the easy-open type.

The lid 10 comprises a closing cap, or panel 12, that can be opened by tearing and defined by at least an incision or pre-cut line 13, able to allow the closing cap 12 to be lifted and at least partly torn. Advantageously, the incision line 13 can have an overall open profile, so that the closing cap 12, once lifted from the lid 10, can still remain connected to it ("stay-on tab").

The lid 10 also comprises an opening lever, or tab 14, disposed astride the incision line 13 and comprising a front fulcrum end 15 and an intermediate region 16 provided with a flexible tongue 17 attached to the closing cap 12.

The lid also comprises a mechanical element 18, for example a rivet or suchlike, located in proximity to the incision line 13, configured to mechanically attach the flexible tongue 17 to the closing cap and configured to cooperate with the flexible tongue 17.

At the front, in the zone where the closing cap 12 begins to lift and tear, the incision line 13 has a portion 19 protruding toward the outside, toward the front fulcrum end 15 of the opening lever 14.

According to one aspect of the invention, the protruding portion 19 has at both sides segments 20 of the incision line 13 which move away from the mechanical element 18 as far as respective deformation zones 21 caused by compression of the incision line 13 (see for example FIGS. 2, 3, 6, 7).

In this way it is possible to make a protruding portion 19 of rounded and widened shape which, in combination with the deformation zones 21 provided at the end of the segments 20 made on the incision line 13, greatly limits the phenomena of venting/bursting, in particular unintended or explosive venting of known lids.

Figure 6:
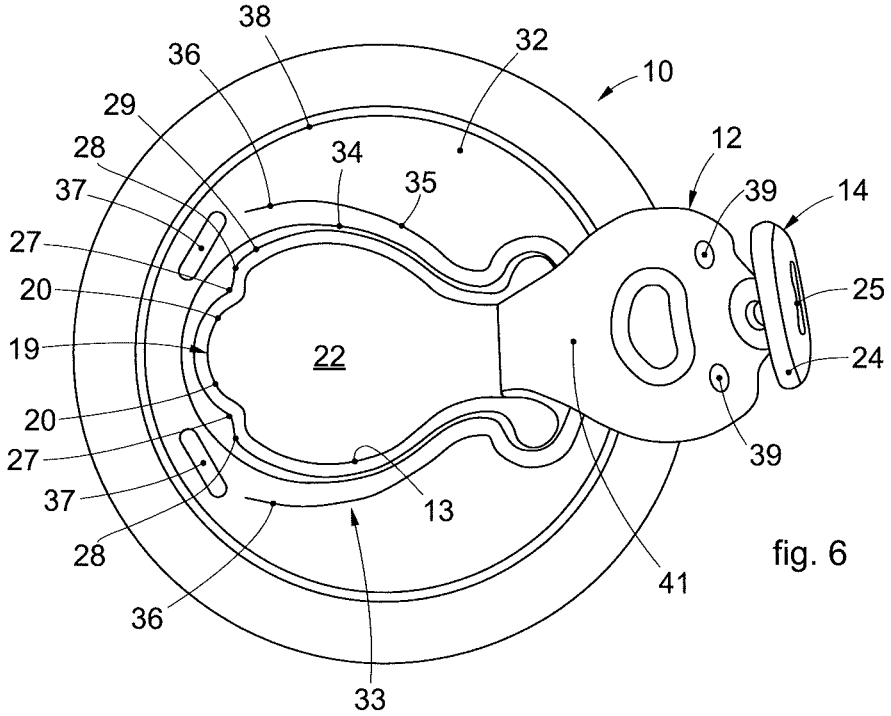
FIG. 6 is a plan view of the present lid when open.
Figure 7:
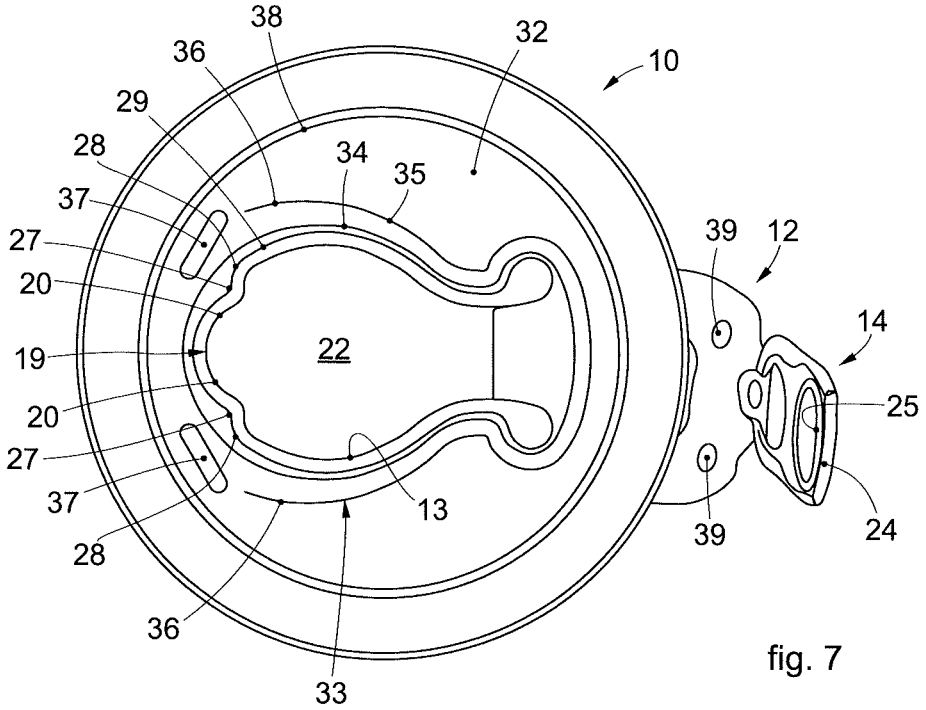
FIG. 7 is a view from below of the present lid when open.

The incision line 13 can delimit a delivery aperture 22 on the perimeter, see for example FIG. 6 and FIG. 7, which is normally closed by the closing cap 12 and through which it is possible to deliver or pour the substance contained in the container 11.

Around the delivery aperture 22, the lid 10 has a closing wall 32, for example of a circular shape, like the container 11 with which it can be associated. The lid 10 can also be delimited by an annular peripheral rib, or bead, 38. Externally to the annular peripheral rib, or bead, 38 there is an edge 26, raised with respect to the plane of the lid 10 and to the closing wall 32.

The closing cap 12 can be lifted or detached from the lid 10, generating the delivery aperture 22 as above.

It is possible to provide that the lid 10 is the "stay-on tab" type. For this purpose, according to some possible embodiments described here, the incision line 13 can be interrupted, that is, it can have an open profile, for example of at least partly curved shape, or in any case with a mixed curvilinear/linear development. The fact that the incision line 13 can be interrupted, that is, it may have an open profile, means that the closing cap 12, once lifted from the lid 10, can still remain connected to it ("stay-on tab"), without the risk of being dispersed in the environment, and thus preventing pollution.

It is possible to provide that, due to the way the development of the incision line 13 is made, the closing cap 12, when lifted, will not easily detach from the rest of the lid 10, for example by breaking, due to the presence of terminal branches 23, for example shaped like curls. The terminal branches 23 are defined by segments of the incision line 13 curved toward the outside, which advantageously also perform an elastic function of absorbing stress, preventing the closing cap 12 from breaking.

Moreover, with reference for example to FIG. 6, the underside surface 41 of the closing cap 12 can be provided with indications, signs, logos or other advertising means for promotional purposes. Such indications may be engraved, printed or obtained by other means on said underside surface 41.

The incision line 13 is substantially a pre-incised or pre-cut line that defines a predetermined breaking profile, along which the closing cap 12 can be torn and detached. The incision line 13 can be made according to techniques known in the state of the art. The incision line can, for example, be doubled, the incision line 13 described here acting as the main one, more internal, and providing an anti-breaking line 29, more external, as can be seen in the attached drawings and as described in detail below.

The opening lever 14 can be disposed astride the incision line 13, partly above the closing cap 12 and partly outside it. The opening lever 14 can have, at one end, a fulcrum part on the lid 10, and at an opposite end it can be lifted. In an intermediate position, the opening lever 14 is attached to the closing cap 12.

The opening lever 14 can be disposed aligned along a median axis A of the lid 10, for example in order to improve the opening effect.

The opening lever 14 can also comprise a rear drive end 24, opposite the front fulcrum end 15. In possible implementations, the rear drive end 24 can comprise a gripping ring 25 which can be easily gripped by the user to lift and rotate the opening lever 14, pivoting on the front fulcrum end 15.

The front fulcrum end 15 can be disposed externally to the incision line 13. In this way, the opening lever 14, when rotated around the front fulcrum end 15, can press on a point outside the incision line 13. The front fulcrum end 15 can be configured to essentially define a single pivoting point of the opening lever 14.

The mechanical element 18, as we said, is configured to mechanically attach or connect the flexible tongue 17 to the closing cap 12, therefore substantially it is a mechanical element to clamp the flexible tongue 17 on the closing cap 12. In particular, the mechanical element 18 is provided inside the incision line 13. The mechanical clamping element 18 can be made of the same material as the lid 10. The mechanical element 18 can be shaped for example with an essentially circular shape, having a plan profile with a certain radius.

In accordance with other possible implementations, the mechanical element 18 can be a solid rivet, that is, a flat-headed nail, pin or bolt, truncated cone shaped or hemispherical, used for joining metal elements, but it goes without saying that these variants require different production cycle times.

Or, in other possible implementations, the mechanical element 18 can be a hollow rivet, that is, a joining element similar to a solid rivet, drilled in the middle and in the shape of an eyelet, generally formed by a double-headed nail. Typically, a manufacturing process of the lid 10 can provide to mold a simple lid from a roll of aluminum or its alloys, generally aluminum alloys with magnesium, such as for example typically 5182-H48, or based on iron or ferrous alloy, in particular steel, for example mild steel or stainless steel, for example tin-plated or in any case coated, or not.

In particular, the mechanical element 18 can be a rivet having an average diameter of about 3 mm to about 4 mm.

The incision line 13, as we said, comprises a protruding portion 19 with a rounded and widened shape, for example the protruding portion 19 can be in the shape of a circular arc or suchlike. Preferably, the protruding portion 19 has a width W1 of about 8 mm to about 10 mm. It has been found in experiments that this value is optimal for counteracting the phenomena of venting/bursting, in particular unintended or explosive venting when opening the container 11.

Moreover, in order to further improve this limiting effect, the protruding portion 19 can be made in the shape of an arc of a circle and can have a radius of curvature of about 5 to about 6 mm.

Advantageously, the radius of the protruding portion 19 is greater than the radius of the mechanical element 18 and the profile of the protruding portion 19 continues, as we said, moving away from the mechanical element 18 by means of the segments 20 of the incision line 13, up to the respective deformation zones 21 of the material, where there is a change in the opening direction, defined by an internal radius, able to prevent, on the one hand, the closing cap 12 from being torn and, on the other hand, the venting action from continuing to unintentionally open the closing cap 12, also in a violent way. This aspect, in combination with the deformation zones 21 of the metal material in this transition region and the change of the opening direction of the incision line 13, allows to adequately control the venting action.

In particular, each of the deformation zones 21 which substantially delimit the protruding portion 19 can comprise at least a first curvature 27 having a concavity facing toward the outside of the lid 10 and at least a second curvature 28 having a concavity facing toward the inside of the lid 10. This sequence of first 27 and second curvature 28 can advantageously define the transition and change in the opening direction of the incision line 13.

An optimal value for the radius of curvature of the first curvature 27 can be about 1.5 mm to about 2.5 mm.

An optimal value for the radius of curvature of the second curvature 28 can be about 2 mm to about 3 mm.

The deformation zone 21 can be obtained for example by means of mechanical compression of the material, in particular punching, riveting or coining. The diameter D1 of the deformation zone 21, see FIG. 5, can for example be about 1 mm to about 3 mm.

In addition to the incision line 13, the lid 10 can comprise an anti-breaking line 29 positioned around the incision line 13. The anti-breaking line 29 can be shaped so as to follow the profile of the incision line 13, at least in a zone of the closing cap 12 comprised between a rear flap 30 of the closing cap 12 and the zone of the closing cap 12 where the mechanical element 18 is positioned.

The anti-breaking line 29 substantially has the function of increasing the stability of the lid 10 and making it easier to open the closing cap 12.

The anti-breaking line 29 and the incision line 13 are connected in proximity to the rear flap 30 of the closing cap 12 by means of the terminal branches 23.

Figure 4:
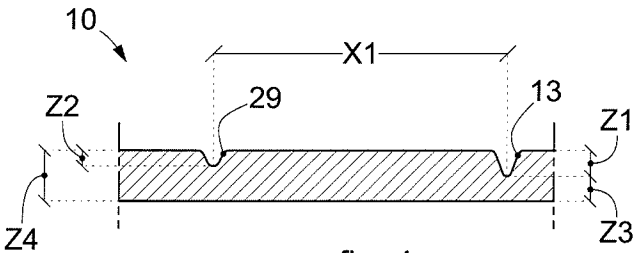
FIG. 4 is a section view of the lid considered along the line IV-IV of FIG. 3.
Figure 5:
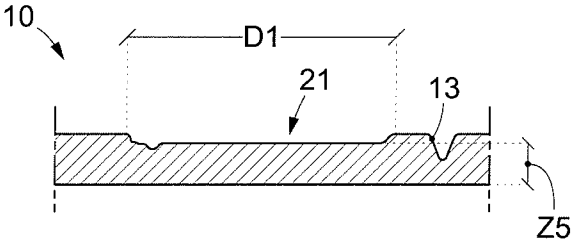
FIG. 5 is a section view of the lid considered along the line V-V of FIG. 3.

The incision line 13 and the anti-breaking line 29 are also shown in the sections of FIG. 4 and FIG. 5.

The incision line 13 can be made for example by means of a converging incision, that is, for example, V-shaped.

The average distance X1 between the incision line 13 and the anti-breaking line 29 can be, for example, about 1 mm to about 2 mm. The average distance X1 proved to be optimal to ensure stability of the lid 10 by means of the anti-breaking line 29 and at the same time a convenient opening step of the closing cap 12 along the incision line 13.

The depth Z1 of the incision line 13 can be greater than the depth Z2 of the anti-breaking line 29. In this way, during the lifting of the closing cap 12, the wall 32 of the lid 10 has a lower thickness below the incision line 13 with respect to the thickness under the anti-breaking line 29.

In particular, the depth Z1 of the incision line 13 is about 0.05 mm greater than the depth Z2 of the anti-breaking line 29.

The thickness Z3 of the lid 10 under the incision line 13 can be about 1 mm to about 1.5 mm.

Moreover, the thickness Z4 of the lid 10, in a zone comprised between the incision line 13 and the anti-breaking line 29 is about 1.5 mm to about 2.5 mm.

The thickness Z5 of the lid 10 in correspondence with the deformation zone 21 can be of about 1.5 mm to about 2 mm.

The deformation zone 21, as can be seen from a comparison of FIG. 4 and FIG. 5, can also extend beyond the anti-breaking line 29.

The minimum distance Y1, see FIG. 3, between the anti-breaking line 29 and the center of the mechanical element 18 can be about 4 mm to about 5 mm.

The minimum distance Y2 between the incision line 13 and the center of the mechanical element 18 can be about 1.5 mm to about 2.5 mm.

The lid 10 can also comprise a reinforcement edge 33 defined by at least a first reinforcement line 34 and by at least a second reinforcement line 35. The reinforcement lines 34 and 35 are curved and at least partly follow the shaping of the incision line 13 and possibly of the anti-breaking line 29, see in particular FIG. 2 and FIG. 3. The reinforcement lines 34 and 35 can be for example incisions, ribs or other.

In particular, the first reinforcement line 34 can be a closed line that completely surrounds the incision line 13. It can have a connecting arc 31 at the top. An optimal value of the radius of curvature of the connecting arc 31 can be about 1.5 mm to about 2.5 mm.

The second reinforcement line 35 can be an open line which partly surrounds the first reinforcement line 34 and comprises, on one side and the other of the incision line 13, two branches 36 which are interrupted substantially at the height of the deformation zone 21 of the incision line 13.

The interruption of the reinforcement line 34 allows the wall 32 of the lid 10 to remain substantially unchanged in the zone where the flexible tongue 17 will be applied, that is, so that the wall 32 is substantially flat and there are no slopes resulting from incisions or other.

The branches 36 of the second reinforcement line 35 can also diverge from the first reinforcement line 34. In essence, as can be observed for example in FIG. 2 or FIG. 3, the free end of the branches 36 is the furthest point of the branches 36 with respect to the first reinforcement line 34.

The divergence of the branches 36 can be provided in order to have a greater transition zone from the first reinforcement line 34 to the second reinforcement line 35, especially in a position close to the deformation zone 21.

The thickness of the lid 10 in correspondence with the reinforcement edge 33 can be of about 0.4 mm to about 0.6 mm.

The minimum distance Y3 between the first reinforcement line 34 and the center of the mechanical element 18, see in particular FIG. 3, can be about 5 mm to about 7 mm.

The lid may also comprise lateral centering ridges 37, which cooperate with the front lateral edge of the opening lever 14 in order to center it. Each of the lateral centering ridges 37 can have a parallelepiped shape having a length of about 7 mm to about 8 mm, a width of about 2 mm to about 3 mm and a height of about 0.2 mm to about 1 mm.

The lid 10 can also comprise bosses 39, see FIG. 3, to position the opening lever 14, or to correctly position the opening lever 14 with respect to the plane of the lid 10. The bosses 39 are made protruding from the closing cap 12 toward the opening lever 14 above.

For example, two bosses 39 can be provided, made under the opening lever 14 and symmetrical with respect to the median axis A.

The lid 10 can also be equipped with a central boss 40, made protruding from the closing cap 12, which cooperates with the gripping ring 25 of the opening lever 14.

In particular, the central boss 40 can be disposed along the median axis A and is centered inside the hole of the gripping ring 25. The central boss 40 has been designed to improve and guarantee the exact axial centering of the opening lever 14.

In the sequence of drawings from 8 to 11, an opening sequence of the lid 10 is shown, by way of non-restrictive example.

Figure 8:
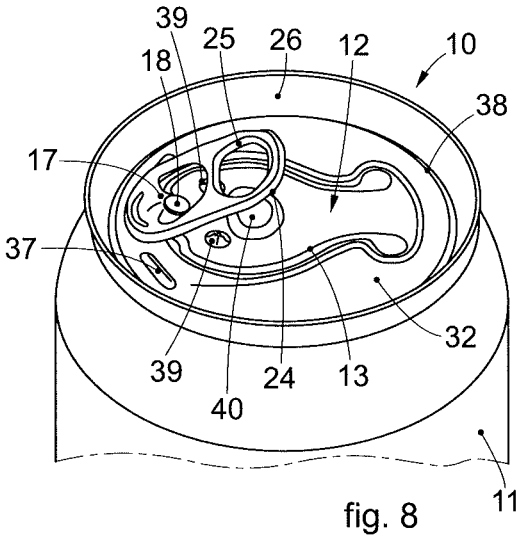
FIGS. 8 to 11 are three-dimensional views that show a possible opening sequence of the lid.
Figure 9:
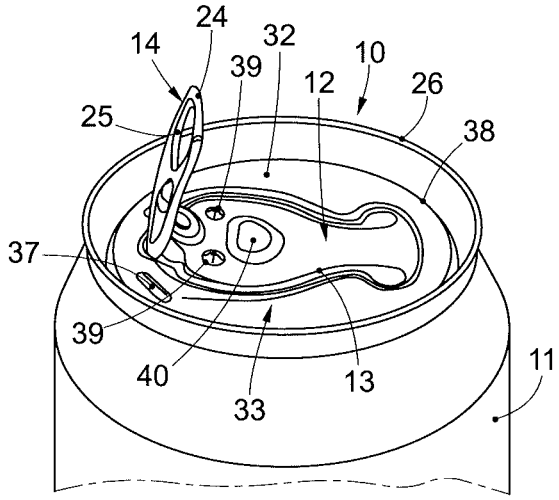
Figure 10:
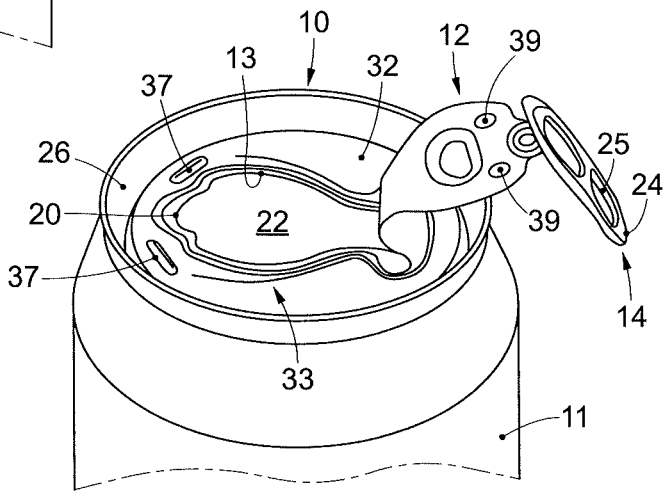
Figure 11:
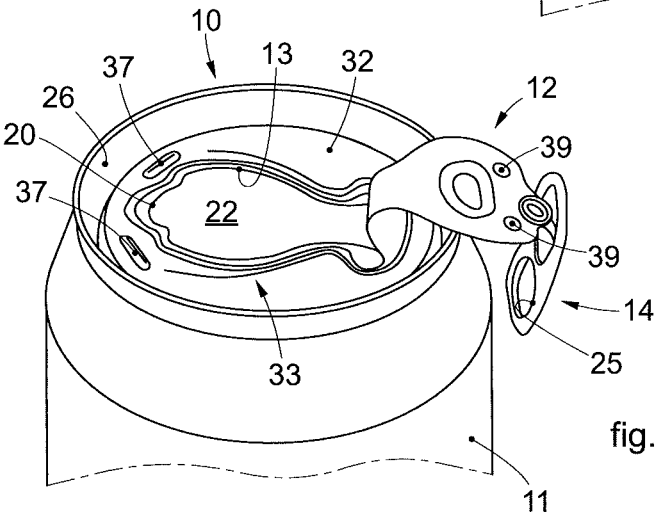

The flexible tongue 17 is gripped by the user and rotated upward and toward the outside of the container 11. After a certain inclination of the flexible tongue 17, the closing cap 12 begins to detach from the lid 10, along the incision line 13, see FIG. 8 and FIG. 9. In particular, the resistance of the mechanical element 18 causes the initial detachment of the closing cap 12, which is immediately lifted by the initial tear, in precise correspondence with the incision line 13, in particular with its protruding portion 19, preventing even the minimum part or flap of the closing cap 12 from going inside the container 11, contaminating the substance contained therein. In other words, the first zone of the closing cap 12 which detaches from the rest of the lid 10 is the zone close to the protruding portion 19 of the incision line 13. By pulling the flexible tongue 17 in the opposite direction with respect to the lifting rotation, the closing cap 12 is pulled in the opposite direction with respect to the protruding portion 19 until it reaches the situation shown in FIG. 10 or FIG. 11. Thus, a hygienic lid can be advantageously obtained.

By using the lid 10, the effort necessary to lift the closing cap 12 along the incision line 13, as well as being much lower compared with containers with a hygienic cap, that is, a cap that opens toward the outside, as known in the state of the art, is also much better distributed and exploited, so that the operation leads to a uniform, precise, repeatable and reliable detachment.

Furthermore, in a first opening step, thanks to the provision of the protruding portion 19 substantially delimited by the deformation zones 21 and with the segments 20 moving away from the mechanical element 18, the phenomena of venting/bursting, in particular unintended or explosive venting are limited which, instead, can occur when opening containers with lids known in the state of the art.

It is clear that modifications and/or additions of parts may be made to the lid for containers as described heretofore, without departing from the field and scope of the present invention.

In the following claims, the sole purpose of the references in brackets is to facilitate reading: they must not be considered as restrictive factors with regard to the field of protection claimed in the specific claims.

The invention claimed is:

1. A lid for a metal container able to contain a substance, comprising:

a closing cap defined by at least one incision line, able to allow the closing cap to be lifted and at least partly torn, an opening lever disposed astride the incision line and comprising a front fulcrum end and an intermediate region provided with a flexible tongue attached to the closing cap, a mechanical connection located in proximity to the incision line, configured to mechanically attach the flexible tongue to the closing cap and configured to cooperate with said flexible tongue, said incision line having at the front, in the zone where the closing cap starts to be lifted and torn, a portion protruding outward, toward the front fulcrum end of the opening lever, wherein said protruding portion has, on both sides, segments of the incision line which move away from said mechanical connection as far as respective deformation zones, caused by compression of the incision line; and wherein said deformation zone caused by compression comprises at least a first curvature having a concavity facing toward the outside of the lid and at least a second curvature having a concavity facing toward the inside of the lid, and further wherein the succession of said first and second curvature defines said transition and modification in the opening direction of the incision line.

2. The lid for a metal container as in claim 1, wherein said protruding portion is rounded in shape and has a width of about 8 mm to about 10 mm, and wherein said protruding portion is an arc having a radius of curvature of about 5 mm to about 6 mm.

3. The lid for a metal container as in claim 1, wherein the radius of the protruding portion is greater than the radius of the mechanical connection and the profile of the protruding portion continues moving away from the connection by means of said segments as far as the respective deformation zones of the material, where there is a change in the opening direction of the incision line, defined by an internal radius.

4. The lid for a metal container as in claim 1, wherein the radius of curvature of said first curvature is about 1.5 mm to about 2.5 mm, and wherein the radius of curvature of said second curvature is about 2 mm to about 3 mm.

5. The lid for a metal container as in claim 1 wherein said deformation zone caused by compression has a diameter of about 1 mm to about 3 mm.

6. A lid for a metal container able to contain a substance, comprising:

a closing cap defined by at least one incision line, able to allow the closing cap to be lifted and at least partly torn, an opening lever disposed astride the incision line and comprising a front fulcrum end and an intermediate region provided with a flexible tongue attached to the closing cap, a mechanical connection located in proximity to the incision line, configured to mechanically attach the flexible tongue to the closing cap and configured to cooperate with said flexible tongue, said incision line having at the front, in the zone where the closing cap starts to be lifted and torn, a portion protruding outward, toward the front fulcrum end of the opening lever, wherein said protruding portion has, on both sides, segments of the incision line which move away from said mechanical connection as far as respective deformation zones, caused by compression of the incision line;

further comprising an anti-breaking line positioned around said incision line, and further wherein said anti-breaking line is shaped so as to follow the profile of the incision line at least in a zone of the closing cap comprised between a rear flap of the closing cap and the zone of the closing cap where said mechanical connection is positioned and wherein said anti-breaking line and said incision line are connected in proximity to said rear flap of said closing cap by terminal branches.

7. The lid for a metal container as in claim 6, wherein the depth of the incision line is greater than the depth of the anti-breaking line.

8. The lid for a metal container as in claim 6, wherein in a zone comprised between said incision line and said anti-breaking line, it has a thickness of about 1.5 mm to about 2.5 mm.

9. The lid for a metal container as in claim 8, wherein a thickness under the incision line is about 1 mm to about 1.5 mm, and wherein said deformation zone extends beyond said anti-breaking line.

10. The lid for a metal container as in claim 6, wherein the minimum distance between said anti-breaking line and the center of the mechanical connection is about 4 mm to about 5 mm.

11. A lid for a metal container able to contain a substance, comprising:

a closing cap defined by at least one incision line, able to allow the closing cap to be lifted and at least partly torn, an opening lever disposed astride the incision line and comprising a front fulcrum end and an intermediate region provided with a flexible tongue attached to the closing cap, a mechanical connection located in proximity to the incision line, configured to mechanically attach the flexible tongue to the closing cap and configured to cooperate with said flexible tongue, said incision line having at the front, in the zone where the closing cap starts to be lifted and torn, a portion protruding outward, toward the front fulcrum end of the opening lever, wherein said protruding portion has, on both sides, segments of the incision line which move away from said mechanical connection as far as respective deformation zones, caused by compression of the incision line; and further comprising a reinforcement edge defined by at least a first reinforcement line and by at least a second reinforcement line, and wherein said first reinforcement line is a closed line which completely surrounds the incision line, and further wherein said first reinforcement line has a connecting arch, said connecting arch having a radius of curvature of about 1.5 mm to about 2.5 mm.

12. The lid for a metal container as in claim 11, wherein said first reinforcement line has at the top a connecting arch, said connecting arch having a radius of curvature of about 1.5 mm to about 2.5 mm.

13. The lid for a metal container as in claim 11, wherein said second reinforcement line is an open line which partly surrounds said first reinforcement line and comprises on one side and the other of the incision line two branches which break substantially at the height of the deformation zone caused by compression of the incision line, and wherein said branches of the second reinforcement line are divergent with respect to the first incision line.

14. The lid for a metal container as in claim 11, wherein in correspondence with said reinforcement edge, it has a thickness of about 0.4 mm to about 0.6 mm.

15. The lid for a metal container as in claim 11, wherein the minimum distance between said first reinforcement line and the center of the mechanical connection is about 5 mm to about 7 mm.

16. The lid for a metal container as in claim 1 wherein the minimum distance between said incision line and the center of the mechanical connection is about 1.5 mm to about 2.5 mm.

17. The lid for a metal container as in any claim 1, wherein said mechanical connection is a rivet having an average diameter of about 3 mm to about 4 mm.

18. The lid for a metal container as in any claim 1, further comprising lateral centering ridges, which cooperate with the front lateral edge of the opening lever in order to center the latter, each of said lateral centering ridges having a length of about 7 mm to about 8 mm, a width of about 2 mm to about 3 mm and a height of about 0.2 mm to about 1 mm.

19. A container comprising a lid as in claim 1.

* * * * *